United States Patent [19]

Flair

[11] 4,305,190

[45] Dec. 15, 1981

[54] GEAR BURNISHER

[75] Inventor: Henry J. Flair, Franklin Park, Ill.

[73] Assignee: Illinois Tool Works Inc., Chicago, Ill.

[21] Appl. No.: 152,446

[22] Filed: May 22, 1980

[51] Int. Cl.[3] ..... B24B 39/04

[52] U.S. Cl. ..... 29/90 B; 51/26; 72/107

[58] Field of Search ..... 29/90 R, 90 B; 51/26; 72/107

[56] References Cited

U.S. PATENT DOCUMENTS

| | | | |
|---|---|---|---|
| 3,321,820 | 5/1967 | Rosendahl | 29/90 R |
| 3,611,772 | 10/1971 | Haug | 72/107 |
| 3,813,821 | 6/1974 | Takahashi | 51/26 |
| 4,067,218 | 1/1978 | Bibbens | 72/107 |

FOREIGN PATENT DOCUMENTS

| | | | |
|---|---|---|---|
| 353480 | 9/1970 | U.S.S.R. | 72/107 |

*Primary Examiner*—Nicholas P. Godici

*Attorney, Agent, or Firm*—Thomas W. Buckman; Glenn W. Bowen

[57] ABSTRACT

An improved gear burnisher for removing minor gear tooth defects by burnishing is provided by rotating the work gear to be burnished in mesh with three different burnihing gears, at least one of which is powered. The improvement consists of burnishing the work gear with one burnishing gear that has a low operating pressure angle, another that has a high operating pressure angle and a third burnishing gear that has an intermediate operating pressure angle. The third also preferably has a generated pressure angle that is 0.5 degrees or more greater than the generated pressure angle of the work gear to provide a concentrated radial pressure sliding load at the tips of the teeth of the work gear.

8 Claims, 5 Drawing Figures

GEAR BURNISHER

BACKGROUND OF THE INVENTION

The present invention is directed to an improved apparatus for processing of gears and for removing irregularities on gear tooth surfaces. The present invention is an improvement of the basic gear burnishing apparatus of U.S. Pat. No. 3,321,820 which issued May 30, 1967 to Guenter K. Rosendahl and which is assigned to the assignee of the present invention. The method and apparatus of the prior Rosendahl Patent utilized three burnishing gears which operated on a work gear to remove irregularities on gear tooth surfaces.

In general use are electronic gear checking or gear inspecting machines which determine gear accuracy by meshing and rolling a gear with a master gear of established accuracy. Deviation from the master gear pattern are noted and recorded for such factors as tooth spacing errors and involute inaccuracies which become apparent variations between centers of the gear being tested and the master gear. A portion of the errors are due to small nicks and to minor bumps caused by heat treatment scale, chips, scratches, burrs and foreign particles including dust particles which cling to the teeth surfaces. Such particles may produce test readings of sufficient magnitude to effect a subsequent rejection of the gear during testing even though there are no errors basic to gear accuracy and suitability.

The method and apparatus of the Rosendahl Patent utilized three burnishing gears all of which had substantially equal operating pressure angles and which rolled in mesh with the work gear to reduce irregularities on the gear tooth surfaces of the work gear. While the invention of the Rosendahl Patent provided an appreciable improvement in the processing of gears, the tips of the gear teeth were still subject to nicks and burrs and all areas of the gear tooth flank were not uniformly burnished. Both of these factors have not been found due to the fact that all three burnishing gears of the Rosendahl apparatus employed substantially equal operating pressure angles. The present invention, by utilizing three burnishing gears, all of which have different operating pressure angles, overcomes the above-described problem that was present in the Rosendahl apparatus.

DESCRIPTION OF THE DRAWINGS

Further description of the invention can be had by reference to the drawings in which.

TECHNICAL DESCRIPTION OF THE INVENTION

Figure 1:
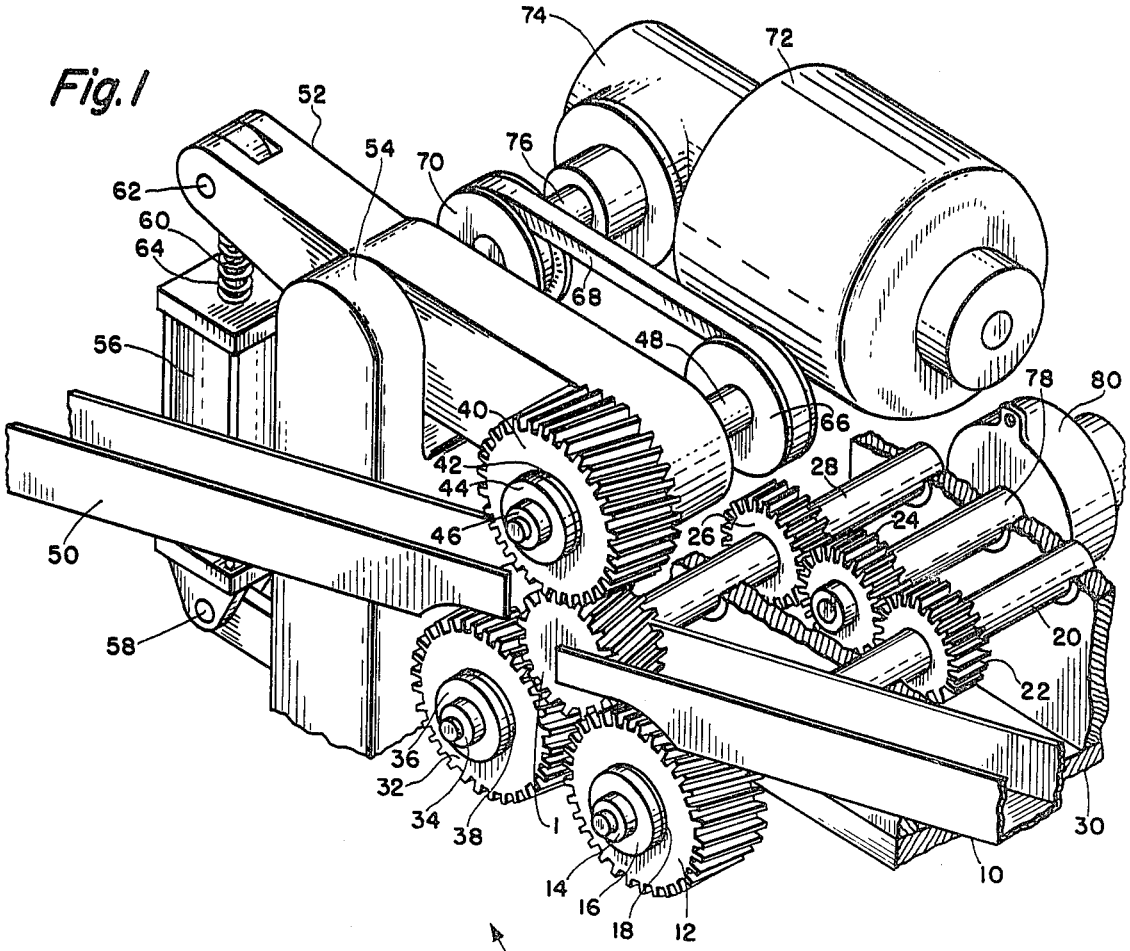
FIG. 1 is a top perspective view of a burnishing device which utilizes the invention.

With reference to FIG. 1, feed chute 10, substantially inclined to the horizontal, terminates at its lower end above driven gear 12, the axis of feed chute 10 being essentially normal to the axis of driven gear 12. The process of burnishing as practiced by this invention comprises bringing gears to be tested successively from a gear supply through feed chute 10 which may be lined with suitable cushioning material such as rubber to protect the gears as they enter and roll through the chute. When feed chute 10 contains more than one gear, a gate or releasing stop mechanism is included at some point along the length of chute 10 above the point at which gear 1 engages driven gear 12 so that the gears are received by the burnisher one at a time.

The apparatus is intended only to burnish gear tooth surfaces by briefly running the gears under load conditions and is not for the purpose of testing for tooth errors. Accordingly, there is no absolutely rigid mounting of the three gears which perform the burnishing. With a measure of flexibility in the mountings it is possible for the apparatus to receive gears to be burnished which may have tooth errors of a rather substantial sort. Consequently, driven gear 12 is mounted by retaining nut 14 and shoulder disc 16 through shoulder disc pad 18 of pliable resilient material such as rubber, a similar shoulder disc pad being used on the reverse or hidden side of driven gear 12 to cooperatively provide a flexible mounting of driven gear 12 on idler shaft 20. Such mounting may be done in the manner descirbed in U.S. Pat. No. 3,115,712. Toward the other end of idler shaft 20 is idler gear 22 meshed with intermediate gear 24 which, in turn, is meshed with idler gear 26 on idler shaft 28. All three idler gears 22, 24 and 26 are identical and are maintained in meshing engagement by shaft bearing mountings in housing 30 which also supports a solenoid brake controlling the speed of intermediate gear 24 for a purpose to be subsequently described.

In the same manner described for the mounting of driven gear 12, driven gear 32 is mounted on idler shaft 28 by means of retaining nut 34, shoulder disc 36 and resilient shoulder disc pad 38. Positioned above and in parallel axis relationship with driven gears 12 and 32 is driving gear 40 shown mounted by means of similar shoulder disc pad 42, shoulder disc 44 and retaining nut 46 on driving gear shaft 48. However, rigid mounting driving gear 40 is satisfactory, alignment being accomplished by flexibility in the mounting of driven gears 12 and 32. With these means and by a method to be further described, test gear 1 is brought into simultaneous mesh with driving gear 40 and driven gears 12 and 32 and while in mesh under pressure is caused to turn through several rotations before being raised and released from meshing engagement to be moved into exit chute 50 for testing and further handling.

Overarm 52 is so constructed as to pivot at a point along its length on a pin mounted in post 54. In operation, overarm 52 is reciprocally actuated by fluid cylinder 56 pivotally mounted at its base through pin 58 to permit the upper end of rod 60 to move in the arc made by pin 62 in overarm 52. Spring 64 serves as a biasing means to provide a minimum upward pressure acting as a minimum downward pressure at the other end of overarm 52 carrying driving gear 40 in mesh with gear 1 until it is discharged from the burnisher.

Driving the driving gear shaft 48 is a movable system comprising driven pulley 66, belt 68 and drive pulley 70 which is representative of other suitable systems that would permit constant torque transmission to driving gear 40 while overarm 52 is pivoted through a series of positions. Providing power is motor 72 through speed reducer 74 by means of shaft 76, a suitable speed for shaft 76 being on the order of 75 to 100 r.p.m. where this speed is essentially maintained in driving gear 40.

Figure 2:
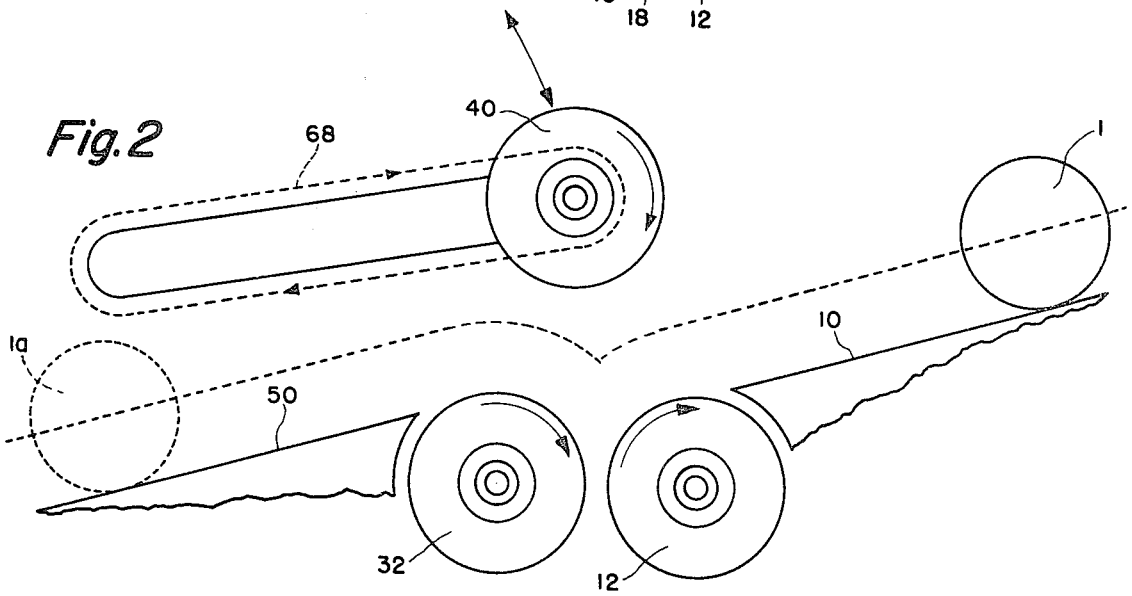
FIG. 2 is a schematic diagram of a device capable of presenting gears for burnishing, burnishing the gears, and then removing them from the burnisher to present them to a subsequent handling or testing procedure.

In a burnishing cycle, which can be of any chosen length of time but which can be conducted in a six second cycle which includes loading and unloading of the gear, gear 1 as shown in FIG. 2, moves downwardly through feed chute 10 tangentially over the top of driven gear 12 and into the valley formed above and between driven gears 12 and 32. Overarm 52 under the minimum downward pressure mentioned, forces driving gear 40, which is constantly rotating, to engage gear 1. With the downward pressure exerted upon it gear 1, in turn, is forced into meshing engagement with driven gears 12 and 32 if meshing has not already occurred, the shafts of these driven gears being synchronized by means of the gear train described earlier which angularly positions both gears for concurrent tooth engagement with gear 1. Sufficient backlash is provided to give the required amount of relative angular tooth displacement necessary for rapid, smooth engagement and disengagement with gear 1. Burnishing is accomplished following actuation of fluid cylinder 56 to raise rod 60 and thereby place an additional downwardly directed force on driving gear 40 producing a pressure loading on gear 1.

After burnishing is completed, the amount of time being variable but capable of being accomplished in a meshing engagement on the order of three to four seconds at the stated speeds, the idler gears 22 and 26 are slowed in their rotation by intermediate gear 24 on shaft 78 controlled by solenoid brake 80 as seen in FIG. 1. Returning to FIG. 2, it can be seen that the resultant slowing of driven gears 12 and 32 while maintaining a constant speed of rotation in driving gear 40 results in driving gear 40 pulling gear 1 out of the valley formed by the two driven gears 12 and 32 whereby gear 1 is first disengaged from gear 12. The higher rotational speed of drive gear 40 in relation to the slowed speed of driven gear 32 proceeds to raise gear 1 moving it while in mesh circumferentially around driven gear 32 to a point where it falls from meshing engagement with both driving gear 40 and driven gear 32. At that point it is free to move downwardly through exit chute 50 through the position represented by gear 1*a*. Driving gear 40 is positioned over the exit chute side of a vertical line intermediate driven gears 12 and 32 to enable gear 1 to be discharged without any additional assistance. In order to accomplish this, gear 1 is raised and moved sufficiently beyond the vertical diameter of driven gear 32 so that its motion and weight will carry it into exit chute 50.

A gate or other releasing stop mechanism at some point along the length of feed chute 10 may be actuated by the lift motion of overarm 52 at the moment when it is released from engagement with gear 1, the following gear to be burnished thereupon being permitted to enter into triangular engagement with driven gears 12 and 32 and descending driving gear 40.

It is to be appreciated that a burnishing apparatus of the type described is designed for large volume burnishing of gears of essentially identical design and dimensions. A change in the type of gear to be burnished will in almost all instances require removal and replacement of driving gear 40 and driven gears 12 and 32 to cause them to correspond with the changed gear type.

From the preceding description, it can be seen that identical tooth spacing is necessary for the driving and driven gears; but they may otherwise be of different sizes so long as a triangular engagement of the gear being burnished can be obtained. Any such change in relative sizes of these three gears will, of course, require changes in relative locations of the gears.

By changing the relative positions and directions of rotation of the gears it is possible to apply power to the lower gear adjacent the exit chute making the uppermost gear a driven gear thereby moving the gear being burnished out of engagement and into the exit chute. In any arrangement it is the relative rates of rotation of the drive gear and driven gear closest to the exit chute which moves the burnished gear out of mesh and discharges it.

Figure 3:
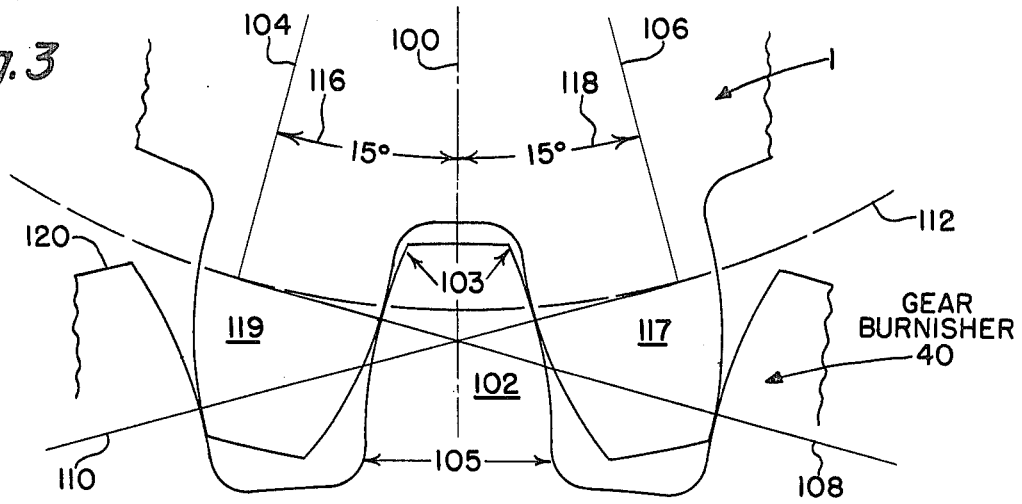
FIGS. 3–5 are diagramatic representations of the specific improvement of the present invention, each of which show a partial top view of the work gear and the meshing burnishing gears.
Figure 4:
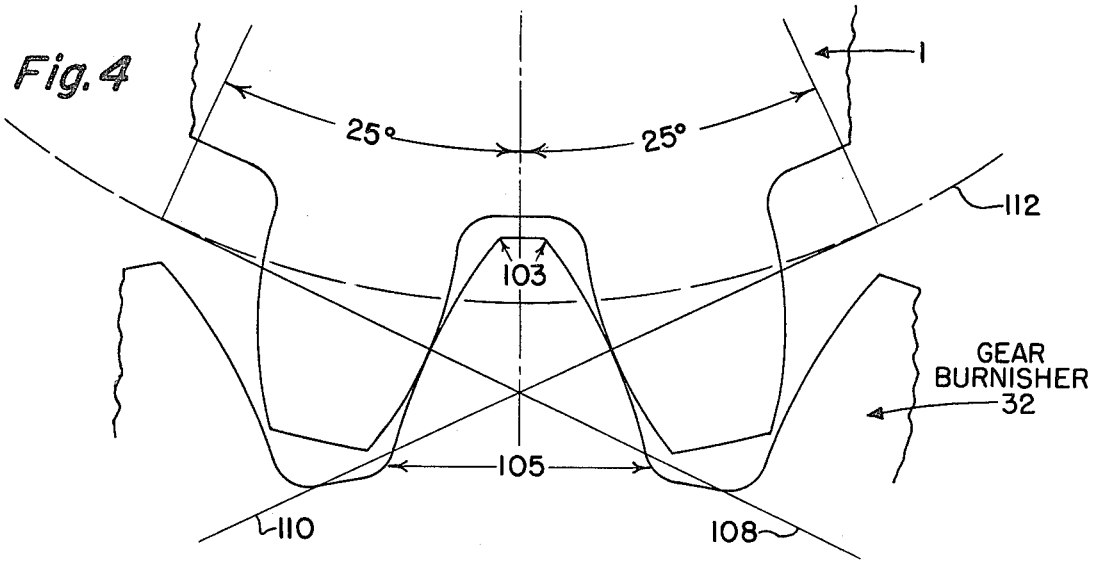
Figure 5:
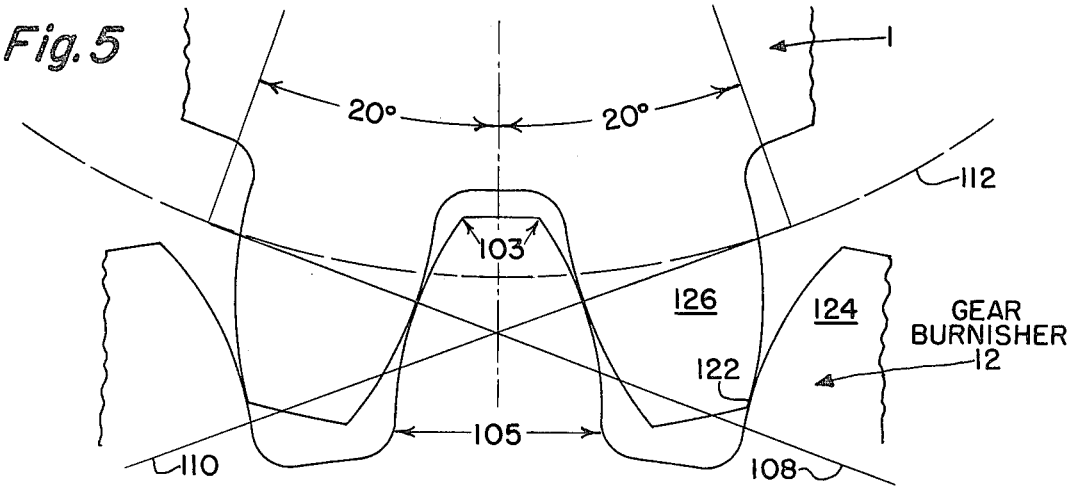

The improvement of the present invention is illustrated in FIGS. 3 to 5 which shows three burnisher gears with standard mating tooth form that provide a tight metal-to-metal mesh with the work gear. In the burnisher of the prior Rosendahl Patent all three gears had the same operating pressure angle and a tooth face width that was greater than the tooth face width of the work gear, which resulted in very little burnishing action along the pitch line. To eliminate this defect the tooth-to-tooth rolling action of each burnishing gear in the present invention is made different, so when they are meshed with a work gear, the radial sliding and the concentrated pressure supplied by each of the burnishing gears is distributed differently on the work gear. This improvement results in a burnishing action that is significantly more uniformly distributed across the gear teeth flanks of the work gear.

In the illustrated example of FIGS. 3 to 5 the work gear 1 has a standard generated pressure angle of 20°. The burnisher gear 40 has a mating diametral pitch with the work gear 1 and also has a generated pressure angle of 20°. The burnisher gear 40, however, has a wider than normal tip 103 and a narrower than normal root 105 so that a tight metal-to-metal mesh with the work gear 1 will provide an operating pressure angle that is less than the standard generated pressure angle of the work gear, for example, an operating pressure angle of 15° may be used, as shown in FIG. 3. The operating pressure angle of the burnisher gear 40 is defined by the line 100, which bisects the burnisher gear tooth 102, and by one of the lines 104, 106. The lines 104, 106 are normal to the tangent lines 108, 110 to the base circle 112 of the work gear 1 at one end, and they terminate at the center (not shown) of the base circle at their other ends. The angles 116, 118 are thus called the "operating pressure angles" and they represent the angular rotation angle of the work gear 1, during which the teeth of the burnisher gear 40 remain in contact with the teeth of the work gear 1. For example, the tooth 119 of the work gear 1 will be in contact with the tooth 120 of the burnisher gear 40 during the 15° rotation of the work gear 1, which is represented by the angle 116. The standard generated pressure angle of 20° is the angle of rotation of the work gear over which the teeth of the work gear would mesh with the burnisher gear if they both had identical tooth forms.

The second burnisher gear 32 has a mating diametral pitch and a 20° generated pressure angle, but it is designed with a narrower than normal tip and a wider than normal root so that a tight metal-to-metal mesh with the work gear 1 will provide an operating pressure angle, that is greater than the generated pressure angle, for example, a 25° operating pressure angle may be used, as shown in FIG. 4, where the same element numbers are used that were used in FIG. 3.

The third burnisher gear 12 has a mating diametral pitch, but preferably has a 20.5°, or higher, generated pressure angle, but it is also designed with a substantially normal width tooth form and an operating pressure angle equal to the generated pressure angle of 20° of the work gear 1. By employment of a 20.5°, or higher, generated pressure angle, a high concentrated radial pressure sliding load is provided on the tooth tip 122 of the tooth 126 of the work gear 1, as shown in FIG. 6. Since nicks and burrs commonly occur at the gear tooth tips, such as the tip 122, the highly concentrated load provided by the gear 12 helps to remove them. This highly concentrated radial sliding action also helps create tip relief in the work gear 1, which is a desirable feature of the present invention.

The burnisher gears 32, 40 provide radial sliding actions which overlap since they are mesh with the customer's work gear at two different operating pressure angles, one of which is greater than the generated pressure angle of the work gear and one of which is less. This overlap creates a very smooth burnished area over the entire flank of the work gear tooth; and, in addition, the burnisher gear 12 concentrates burnishing and nick and burr removal at the tip of the work gear tooth. By the different tooth-to-tooth action of all three burnisher gears 12, 32, 40 as they mesh under load with the work gear 1, a superior burnished surface across the entire gear tooth flank of the teeth of the work gear is thereby provided by the present invention.

What is claimed is:

1. In an apparatus for burnishing gears which comprises three gears having tooth forms and tooth spacing adapted to mesh with a gear to be burnished, said three gears being in substantially parallel axes relation, one of said three gears being a drive gear, means for applying a load to at least one of said three gears and means for changing the relative rates of rotation between at least two of said three gears whereby the gear being burnished is moved out of mesh with said three gears, the improvement wherein each of said three gears has a different operating pressure angle, a first one of which is greater than, a second one of which is less than a third one of which is substantially equal to the generated pressure angle of the gear being burnished.

2. The improvement of claim 1 wherein the generated pressure angle of the gear being burnished is substantially equal to the average of the greater and lesser operating pressure angles of said first and second ones of said three gears.

3. The improvement of claim 1 wherein said third one of said three gears has a generated pressure angle that is at least 0.5 degrees greater than the generated pressure angle of the gear being burnished.

4. The improvement of claim 3 wherein the generated pressure angle of the gear being burnished is substantially equal to the average of the greater and lesser operating pressure angles of said first and second ones of said three gears.

5. In an apparatus for burnishing gears which comprises three gears including a drive gear and a pair of driven gears having tooth forms and tooth spacing adapted to mesh with a work gear to be burnished, said three gears being in substantially parallel axes relation and flexibly mounted to accommodate minor tooth errors in the work gear to be burnished, power means for rotating said drive gear, first gravity feed means for presenting work gears to be burnished singly into meshing engagement with said three gears, loading means for applying pressure to one of said three gears, and brake means for retarding the movement of at least one of said driven gears at the completion of a burnishing operation to cause a change in the relative rate of rotation between said drive gear and said at least one driven gear and thereby lift the work gear out of engagement with said driven gears and into a second gravity feed means for movement away from said three gears, the improvement wherein each of said three gears has a different operating pressure angle, a first one of which is greater than, a second one of which is less than a third one of which is substantially equal to the generated pressure angle of the gear being burnished.

6. The improvement of claim 5 wherein the generated pressure angle of the gear being burnished is substantially equal to the average of the greater and lesser operating pressure angles of said first and second ones of said three gears.

7. The improvement of claim 5 wherein said third one of said three gears has a generated pressure angle that is at least 0.5 degrees greater than the generated pressure angle of the gear being burnished.

8. The improvement of claim 7 wherein the generated pressure angle of the gear being burnished is substantially equal to the average of the greater and lesser operating pressure angles of said first and second ones of said three gears.

* * * * *